US009304419B2

(12) United States Patent
Sato et al.

(10) Patent No.: US 9,304,419 B2
(45) Date of Patent: Apr. 5, 2016

(54) ELECTROSTATIC CHARGE IMAGE DEVELOPING TONER, ELECTROSTATIC CHARGE IMAGE DEVELOPER, TONER CARTRIDGE, AND PROCESS CARTRIDGE

(71) Applicant: FUJI XEROX CO., LTD., Tokyo (JP)

(72) Inventors: Narumasa Sato, Kanagawa (JP); Kotaro Yoshihara, Kanagawa (JP); Eisuke Iwazaki, Kanagawa (JP); Tomoaki Tanaka, Kanagawa (JP); Asafumi Fujita, Kanagawa (JP); Noriyuki Mizutani, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 88 days.

(21) Appl. No.: 14/457,548

(22) Filed: Aug. 12, 2014

(65) Prior Publication Data

US 2015/0220009 A1 Aug. 6, 2015

(30) Foreign Application Priority Data

Feb. 6, 2014 (JP) ..... 2014-021614

(51) Int. Cl.

| | |
|---|---|
| ***G03G 9/08*** | (2006.01) |
| ***G03G 9/087*** | (2006.01) |
| ***G03G 9/097*** | (2006.01) |

(52) U.S. Cl.

CPC ..... *G03G 9/0821* (2013.01); *G03G 9/0819* (2013.01); *G03G 9/08755* (2013.01); *G03G 9/09783* (2013.01)

(58) Field of Classification Search

CPC ..... G03G 9/09783; G03G 9/08755
USPC ..... 430/108.3, 109.4
See application file for complete search history.

(56) References Cited

U.S. PATENT DOCUMENTS

| | | | |
|---|---|---|---|
| 2007/0166635 | A1 | 7/2007 | Yamamoto et al. |
| 2008/0138733 | A1 | 6/2008 | Ueda et al. |

FOREIGN PATENT DOCUMENTS

| | | |
|---|---|---|
| JP | A-2004-109485 | 4/2004 |
| JP | A-2007-192952 | 8/2007 |
| JP | A-2008-145568 | 6/2008 |
| JP | A-2012-13859 | 1/2012 |
| JP | A-2013-142877 | 7/2013 |

*Primary Examiner* — Mark A Chapman
(74) *Attorney, Agent, or Firm* — Oliff PLC

(57) ABSTRACT

An electrostatic charge image developing toner has toner particles that contain a binder resin containing a polyester resin, a release agent containing hydrocarbon-based wax, styrene(meth)acrylic resin particles, and an aluminum element, wherein fluorescent X-ray NET intensity of the aluminum element existing in the toner particles is from 0.1 to 0.3, and 70% or more of the release agent among the entire release agent exists within 800 nm from the surface of the toner particles.

10 Claims, 2 Drawing Sheets

ELECTROSTATIC CHARGE IMAGE DEVELOPING TONER, ELECTROSTATIC CHARGE IMAGE DEVELOPER, TONER CARTRIDGE, AND PROCESS CARTRIDGE

CROSS-REFERENCE TO RELATED APPLICATIONS

This application is based on and claims priority under 35 USC 119 from Japanese Patent Application No. 2014-021614 filed Feb. 6, 2014.

BACKGROUND

1. Technical Field

The present invention relates to electrostatic charge image developing toner, an electrostatic charge image developer, a toner cartridge, and a process cartridge.

2. Related Art

A method of visualizing image information through an electrostatic charge image by electrophotography is currently used in various fields. In electrophotography, image information is formed on a surface of an image holding member (photoreceptor) as an electrostatic charge image through charging and exposing steps, a toner image is developed on the surface of the photoreceptor using a developer including toner, and this toner image is visualized as an image through a transfer step of transferring the toner image on a recording medium such as a sheet and a fixing step of fixing the toner image on a surface of the recording medium.

SUMMARY

According to an aspect of the invention, there is provided an electrostatic charge image developing toner having toner particles containing:

a binder resin containing a polyester resin;

a release agent containing hydrocarbon-based wax;

styrene(meth)acrylic resin particles; and an aluminum element, wherein fluorescent X-ray NET intensity of the aluminum element existing in the toner particles is from 0.1 to 0.3, and 70% or more of the release agent among the entire release agent exists within 800 nm from the surface of the toner particles.

BRIEF DESCRIPTION OF THE DRAWINGS

Exemplary embodiments of the present invention will be described in detail based on the following figures, wherein.

DETAILED DESCRIPTION

Figure 1:
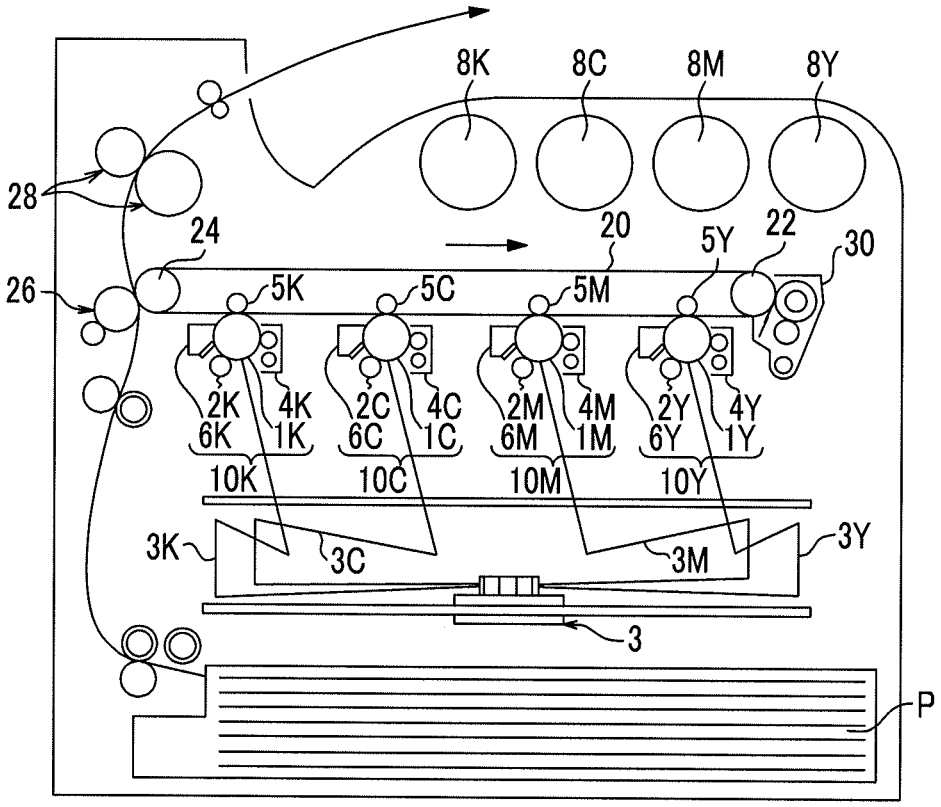
FIG. 1 is a schematic configuration diagram showing an example of an image forming apparatus according to the exemplary embodiment.

Hereinafter, an exemplary embodiment of one example of the invention will be described in detail.

Electrostatic Charge Image Developing Toner

Electrostatic charge image developing toner according to the exemplary embodiment (hereinafter, referred to as a "toner") has toner particles containing a binder resin including a polyester resin, a release agent including hydrocarbon-based wax, styrene(meth)acrylic resin particles, and an aluminum element.

Fluorescent X-ray NET intensity of the aluminum element existing in the toner particles is from 0.1 to 0.3, and 70% or more of the release agent among the entire release agent exists within 800 nm from the surface of the toner particles.

With the toner according to the exemplary embodiment, an image having excellent low glossiness is obtained, and gloss unevenness of a half-tone image is suppressed with the configuration described above. The reason thereof is not clear but the considered reasons are as follows.

First, when the styrene(meth)acrylic resin particles are added to the toner particles containing the binder resin including the polyester resin, and the release agent, an amount of a high molecular weight resin is appeared to be increased, elasticity of the toner particles at the time of fixing increases, and glossiness of an image is decreased.

Meanwhile, since affinity of the styrene(meth)acrylic resin particles and the release agent is high, compatibilization thereof is promoted, and bleeding of the release agent from the toner particles at the time of fixing of toner tends to be inhibited. Accordingly, there may be separation deficiency of the image and gloss unevenness may occur in a half-tone image (for example, half-tone image having image density of 30% to 60%). These phenomena particularly easily occur in the fixing under the conditions with low fixing pressure and a high processing speed (transportation speed of the recording medium) (for example, conditions with the fixing pressure of 0.1 $N/mm^2$ to 0.3 $N/mm^2$ and the processing speed of 200 mm/s to 400 mm/s).

In addition, it is found that the addition of the styrene (meth)acrylic resin particles is not sufficient for obtaining lower glossiness of an image.

With respect thereto, when the fluorescent X-ray NET intensity of the aluminum element existing in the toner particles is controlled to be from 0.1 to 0.3, the elasticity of the toner particles when being fixed may be further increased, and the low glossiness of the image may be promoted.

In addition, when 70% or more of the release agent among the entire release agent is controlled to exist in a surface portion which is within 800 nm from the surface of the toner particles, compatibilization of the styrene(meth)acrylic resin particles and the release agent is suppressed, and the bleeding of the release agent from the toner particles is hardly inhibited. Even when the amount of the release agent is simply increased to cause the release agent to exist in the surface portion of the toner particles, a charging property of the toner is decreased, and an external additive is buried in the toner particles.

In addition, when hydrocarbon-based wax is used as the release agent, compared to ester wax, for example, since the hydrocarbon-based wax has a different chemical structure with respect to the polyester resin, affinity is decreased, and bleeding of the release agent caused to exist in the surface portion of the toner particles is hardly inhibited.

Accordingly, occurrence of the separation deficiency of the image is suppressed, and the gloss unevenness of the half-tone image hardly occurs.

In addition, in the fixed image, the hydrocarbon-based wax and the styrene(meth)acrylic resin particles are partially compatibilized, viscosity of the area including the styrene(meth) acrylic resin decreases to be close to the viscosity of the area including the polyester resin. Accordingly, occurrence of gloss unevenness caused by a difference in viscosity between the areas may also be suppressed.

As described above, with the toner according to the exemplary embodiment, the image having excellent low glossiness is obtained, and gloss unevenness of a half-tone image is suppressed with the configuration described above. In particular, even under the fixing conditions (fixing conditions with the low fixing pressure and high processing speed) where the gloss unevenness of the half-tone image easily occurs, the gloss unevenness is suppressed.

When the styrene(meth)acrylic resin particles are added to the toner particles containing the binder resin including the polyester resin, and the release agent, the amount of the high molecular weight resin is relatively increased, and the elasticity of the toner particles when being fixed is increased, and accordingly both of a low temperature fixability and offset resistance are easily obtained.

Hereinafter, the toner according to the exemplary embodiment will be described in detail.

The toner according to the exemplary embodiment includes the toner particles. The toner may include an external additive which is externally added to the toner particles.

Toner Particles

The toner particles contains the binder resin, the release agent, and the styrene(meth)acrylic resin particles. The toner particles may include other additives such as a colorant.

Herein, the toner particles, for example, have a sea-island structure in which the release agent and the styrene(meth) acrylic resin particles are dispersed in the binder resin.

Binder Resin

As the binder resin, the polyester resin is used from a viewpoint of the fixability. A rate of the polyester resin with respect to the entire binder resin is, for example, preferably equal to or greater than 85% by weight, more preferably equal to or greater than 95% by weight, and even more preferably 100% by weight.

As the polyester resin, a well-known polyester resin is used, for example.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

A glass transition temperature (Tg) of the polyester resin is preferably from 50° C. to 80° C., and more preferably from 50° C. to 65° C.

The glass transition temperature is acquired by a DSC curve obtained by differential scanning calorimetry (DSC), and more specifically, is acquired by "extrapolation glass transition starting temperature" disclosed in a method of acquiring the glass transition temperature of JIS K7121-1987 "Testing Methods for Transition Temperature of Plastics".

A weight-average molecular weight (Mw) of the polyester resin is preferably from 5,000 to 1,000,000, and more preferably from 7,000 to 500,000.

The number-average molecular weight (Mn) of the polyester resin is preferably from 2,000 to 100,000.

The molecular weight distribution Mw/Mn of the polyester resin is preferably from 1.5 to 100, and more preferably from 2 to 60.

The weight-average molecular weight and the number-average molecular weight are measured by gel permeation chromatography (GPC). The molecular weight measurement by GPC is performed with a THF solvent using HLC-8120 GPC, which is GPC manufactured by Tosoh Corporation as a measurement device by using TSKgel Super HM-M (15 cm), which is a column manufactured by Tosoh Corporation. The weight-average molecular weight and the number-average molecular weight are calculated using a calibration curve of molecular weight created with a monodisperse polystyrene standard sample from results of this measurement.

The polyester resin is obtained with a well-known preparing method. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is preferably from 40% by weight to 95% by weight, more preferably from 50% by weight to 90% by weight, and even more preferably from 60% by weight to 85% by weight, with respect to the entire toner particles.

In addition, as the binder resin, other binder resins may be used in combination with the polyester resin.

Examples of the other binder resins include a homopolymer of a monomer such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl esters (for example, vinyl methyl ether, vinyl isobutyl ether, or the like), vinyl ketones (for example, vinyl methyl ketone, vinyl ethyl ketone, vinyl isopropenyl ketone, or the like), and olefins (for example, ethylene, propylene, butadiene, or the like), or a vinyl resin formed of a copolymer obtained by combining two or more kinds of the monomers (herein, except for the styrene (meth)acrylic resin).

Examples of the other binder resins include a non-vinyl resin such as an epoxy resin, a polyester resin, a polyurethane resin, a polyamide resin, a cellulose resin, a polyether resin, and modified rosin, a mixture of these and the vinyl resin, or a graft polymer obtained by polymerizing the vinyl monomer under coexistence thereof.

The other binder resins may be used alone or in combination with two or more kinds thereof.

Release Agent

70% or more of the release agent among the entire release agent exists within 800 nm from the surface of the toner particles. Hereinafter, the existence of the release agent existing within 800 nm from the surface of the toner particles is referred to as an "existence ratio of the release agent".

The existence ratio of the release agent is preferably equal to or greater than 70% and more preferably equal to or greater than 80%.

In addition, in order to set the existence ratio of the release agent to the range described above, a method of using the release agent when forming a shell of the toner particles having a core/shell structure, is used, for example.

The existence ratio of the release agent is a value measured with the following method.

First, toner is mixed with and embedded in the epoxy resin, and the epoxy resin is solidified. After that, the obtained solidified product is cut with an ultra-microtome device (Ultracut UCT manufactured by Leica), and a thin sample having a thickness of 80 nm to 130 nm is prepared. Next, the obtained thin sample is dyed in a desiccator at 30° C. for 3 hours with osmium tetroxide. A SEM image of the dyed thin sample is obtained with a ultrahigh-resolution field emission scanning type electron microscope (SEM: S-4800 manufactured by Hitachi High-Technologies Corporation). Herein, since the polyester resin, the styrene(meth)acrylic resin, and the release agent are easily dyed with osmium tetroxide in this order, each component is identified with gradation caused by a dyed extent. When it is difficult to differentiate the gradation due to the state of the sample, the dying time is adjusted.

The dyed release agent (domain thereof) is observed in the cross section of the toner particles of the SEM image, an area of the release agent in the entirety of the toner particles and an area of the release agent existing in an area within 800 nm from the surface of the toner particles are acquired, and a ratio of areas (area of the release agent existing in an area within 800 nm from the surface of the toner particles/area of the release agent in the entirety of the toner particles) is calculated. Then, the calculation is performed for 10 toner particles, and an average value thereof is set as the existence ratio of the release agent.

As the release agent, hydrocarbon-based wax is used. A rate of the hydrocarbon-based wax with respect to the entire release agent is preferably at least equal to or greater than 85% by weight, more preferably equal to or greater than 95% by weight, and even more preferably 100% by weight.

The hydrocarbon-based wax is a wax including hydrocarbon as a skeleton, and examples thereof include Fischer Tropsch wax, polyethylene wax (wax including a polyethylene skeleton), polypropylene wax (wax including a polypropylene skeleton), paraffin wax (wax including a paraffin skeleton), microcrystalline wax, and the like. Among these, as the hydrocarbon-based wax, Fischer Tropsch wax is preferable, from a viewpoint of suppressing gloss unevenness of the half-tone image.

A melting temperature of the release agent is, for example, preferably from 85° C. to 110° C. and more preferably from 90° C. to 105° C., from viewpoints of improvement of low glossiness of the image and the suppression of the gloss unevenness of the half-tone image.

The melting temperature of the release agent is obtained from "melting peak temperature" described in the method of obtaining a melting temperature in JIS K7121-1987 "testing methods for transition temperatures of plastics", from a DSC curve obtained by differential scanning calorimetry (DSC).

Herein, an exposure rate of the release agent (exposure rate of the release agent on the surface of the toner particles) is, for example, preferably equal to or smaller than 8 atomic %, more preferably equal to or smaller than 5 atomic %, and even more preferably equal to or smaller than 3 atomic %, from viewpoints of fluidity, the charging property, and a transfer property of the toner.

In addition, in order to set the exposure rate of the release agent in the range described above, a method of using the release agent when forming a shell of the toner particles having a core/shell structure, and adjusting a ratio of the release agent and the polyester resin is used, for example.

The exposure rate of the release agent is a value measured by XPS (X-ray photoelectron spectroscopy) measurement.

The XPS (X-ray photoelectron spectroscopy) measurement is performed using the toner particles as measurement samples. As the XPS measurement device, JPS-9000MX manufactured by JEOL Ltd. is used, and the measurement is performed using a MgKα ray as the X-ray source, and setting an accelerating voltage to 10 kV and an emission current to 30 mA. Herein, an amount of the release agent on the surface of the toner particles is determined by a peak separation method of a C1S spectrum. In the peak separation method, the measured C1S spectrum is separated into each component using curve fitting by a least square method. As the component spectrum to be a separation base, the C1S spectrum obtained by singly measuring the release agent, and the resin used in preparing the toner particles is used.

In a case where the external additive is externally added to the toner, the toner is dispersed in ion exchange water to which a dispersant such as a surfactant is added, for example, and the external additive and the toner particles are separated from each other by applying ultrasonic waves with an ultrasonic homogenizer (US-300T manufactured by NISSEI Corporation). After that, only the toner particles are extracted by a filtrating process and a washing process, and the toner particles are set as the measurement samples.

The content of the release agent is, for example, preferably from 1% by weight to 20% by weight and more preferably from 5% by weight to 15% by weight, with respect to the entirety of the toner particles.

Styrene(Meth)Acrylic Resin Particles

The styrene(meth)acrylic resin particles are particles of a copolymer obtained by copolymerizing at least a monomer including a styrene skeleton and a monomer including a (meth)acrylic acid skeleton. The term "(meth)acrylic" is an expression including both "acrylic acid" and "methacrylic acid".

Examples of the monomer including a styrene skeleton (hereinafter, referred to as a "styrenic monomer") include styrene, alkyl-substituted styrene (for example, α-methyl styrene, 2-methylstyrene, 3-methylstyrene, 4-methylstyrene, 2-ethylstyrene, 3-ethylstyrene, 4-ethylstyrene, and the like), halogen-substituted styrene (for example, 2-chlorostyrene, 3-chlorostyrene, 4-chlorostyrene, and the like), vinyl naphthalene, and the like. The styrenic monomer may be used alone or in combination of two or more kinds thereof.

Among these, as the styrenic monomer, styrene is preferable from viewpoints of favorable reactivity, easy control of the reaction, and availability.

Examples of the monomer including a (meth)acrylic skeleton (hereinafter, referred to as a "(meth)acrylic monomer") include (meth)acrylic acid, (meth)acrylic acid ester, and the like. Examples of the (meth)acrylic acid ester include alkyl (meth)acrylate (for example, n-methyl(meth)acrylate, n-ethyl(meth)acrylate, n-propyl(meth)acrylate, n-butyl (meth)acrylate, n-pentyl(meth)acrylate, n-hexyl acrylate, n-heptyl(meth)acrylate, n-octyl(meth)acrylate, n-decyl (meth)acrylate, n-dodecyl(meth)acrylate, n-lauryl(meth) acrylate, n-tetradecyl(meth)acrylate, n-hexadecyl(meth) acrylate, n-octadecyl(meth)acrylate, isopropyl(meth) acrylate, isobutyl(meth)acrylate, t-butyl(meth)acrylate, isopentyl(meth)acrylate, amyl(meth)acrylate, neopentyl (meth)acrylate, isohexyl(meth)acrylate, isoheptyl(meth) acrylate, isooctyl(meth)acrylate, 2-ethylhexyl(meth)acrylate, cyclohexyl(meth)acrylate, t-butylcyclohexyl(meth) acrylate, and the like), aryl ester(meth)acrylate (for example, phenyl(meth)acrylate, biphenyl(meth)acrylate, diphenylethyl(meth)acrylate, t-butylphenyl(meth)acrylate, terphenyl (meth)acrylate, and the like), dimethylaminoethyl(meth) acrylate, diethylaminoethyl(meth)acrylate, methoxyethyl (meth)acrylate, 2-hydroxyethyl(meth)acrylate, β-carboxyethyl(meth)acrylate, (meth)acrylamide, and the like. The (meth)acrylic monomer may be used alone or in combination of two or more kinds thereof.

Herein, a weight ratio of the styrenic monomer and the (meth)acrylic monomer (styrenic monomer/(meth)acrylic monomer)) is, for example, preferably from 85/15 to 70/30.

The styrene(meth)acrylic resin particles preferably include a crosslinked structure from viewpoints of low glossiness of the image and offset resistance. For example, as the styrene (meth)acrylic resin particles including a crosslinked structure, particles of a crosslinked product obtained by copolymerizing and crosslinking at least the monomer including a styrene skeleton, the monomer including a (meth)acrylic acid skeleton, and a cross-linkable monomer are used.

Examples of the cross-linkable monomer include a bi- or higher functional cross-linking agent.

Examples of the bifunctional cross-linking agent include divinyl benzene, divinyl naphthalene, a di(meth)acrylate compound (for example, diethylene glycol di(meth)acrylate, methylenebis(meth)acrylamide, decane diol diacrylate, glycidyl(meth)acrylate, and the like), polyester type di(meth) acrylate, 2-([1'-methylpropylidene amino]carboxy amino)ethyl methacrylate, and the like.

Example of the multifunctional cross-linking agent include a tri(meth)acrylate compound (for example, pentaerythritol tri(meth)acrylate, trimethylolethane tri(meth) acrylate, trimethylolpropane tri(meth)acrylate, and the like), a tetra(meth)acrylate compound (for example, tetramethylolmethane tetra(meth)acrylate, oligoester(meth)acrylate, and the like), 2,2-bis(4-methacryloxy, polyethoxyphenyl)propane, diallyl phthalate, triallyl cyanurate, triallyl asocyanurate, triallyl isocyanurate, triallyl trimellitate, diaryl chlorendate, and the like.

Herein, a weight ratio of the cross-linkable polymerizable monomer with respect to the entire monomer (cross-linkable polymerizable monomer/entire monomer) is, for example, preferably 2/1000 to 30/1000.

A number-average particle size of the styrene(meth)acrylic resin particles is, for example, preferably from 70 nm to 300 nm and more preferably from 90 nm to 150 nm, from viewpoints of the low glossiness of the image and the offset resistance.

Regarding the number-average particle size of the styrene (meth)acrylic resin particles, the dyed styrene(meth)acrylic resin particles are observed in the SEM image used when calculating the existence ratio of the release agent, each circle equivalent size of 100 particles is acquired, and ($50^{th}$) circle equivalent size with a cumulative percentage of 50% from the side of the smallest size of the number-based distribution is set as the number-average particle size.

A weight-average molecular weight Mw of the styrene (meth)acrylic resin particles is, for example, preferably from 30,000 to 200,000, more preferably from 40,000 to 100,000, and even more preferably from 50,000 to 80,000, from the viewpoints of the low glossiness of the image and the offset resistance.

In addition, the weight-average molecular weight Mw of the styrene(meth)acrylic resin particles is a value measured in the same method as the weight-average molecular weight of the polyester resin.

The content of the styrene(meth)acrylic resin particles is, for example, preferably from 10% by weight to 30% by weight, more preferably from 12% by weight to 28% by weight, and even more preferably from 15% by weight to 25% by weight with respect to the toner particles, from the viewpoints of the low glossiness of the image and the offset resistance. A weight ratio of the release agent and the styrene (meth)acrylic resin particles is preferably in a range of 1:6 to 2:1.

Aluminum Element

As a source of the aluminum element (compound to be added to the toner as an additive), an aggregating agent added when preparing the toner particles in an aggregation and coalescence method, for example, is used.

Examples of the aggregating agent including Al include aluminum sulfate, polyaluminum chloride, polyaluminum hydroxide, and the like.

In addition, these aggregating agents may not be used as an aggregating agent, and may be simply added as additives.

As other sources of the aluminum element, aluminum chloride hexahydrate or aluminum nitrate nonahydrate to be added as an additive for sufficiently washing impurities of the surfactant or the like when performing washing after granulation of toner particles.

The content of the aluminum element is measured using the fluorescent X-ray NET intensity. In detail, the fluorescent X-ray NET intensity of the aluminum element existing in the toner particles is, for example, preferably from 0.1 to 0.3, more preferably from 0.12 to 0.28, and even more preferably from 0.16 to 0.24, from the viewpoints of the low glossiness of the image and the offset resistance.

The fluorescent X-ray NET intensity of the aluminum element is a value measured with the following method.

First, a disc is formed by using 0.130 g of the toner particles. The intensity of the obtained disc is measured with a qualitative/quantitative element analysis method by using an X-ray fluorescence spectrometer (XRF-1500 manufactured by Shimadzu Corporation), under the conditions with X-ray output of 40 V-70 mA, a measurement area of 10 mmϕ, and the measurement time of 15 minutes, and the obtained AlKα intensity (intensity of a peak derived from Al) is measured as the "fluorescent X-ray NET intensity of the aluminum element". When the peak derived from Al and the peak derived from the other element are overlapped with each other, the intensity of the peak derived from Al is calculated after performing analysis with an ICP emission spectrometry or an atomic absorption method.

In a case where the external additive is externally added to the toner, the toner is dispersed in ion exchange water to which a dispersant such as a surfactant is added, for example, and the external additive and the toner particles are separated from each other by applying ultrasonic waves with the ultrasonic homogenizer (US-300T manufactured by NISSEI Corporation). After that, only the toner particles are extracted by the filtrating process and the washing process, and the toner particles are set as the measurement samples.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination.

The content of the colorant is, for example, preferably from 1% by weight to 30% by weight, and more preferably from 3% by weight to 15% by weight with respect to the entirety of the toner particles.

Other Additives

Examples of other additives include known additives such as a magnetic material, a charge-controlling agent, and an inorganic powder. The toner particles contain these additives as internal additives.

Characteristics of Toner Particles

The toner particles may be toner particles having a single-layer structure, or toner particles having a so-called core/shell structure composed of a core (core particle) and a coating layer (shell layer) coated on the core.

Here, toner particles having a core/shell structure is preferably composed of, for example, a core containing a binder resin, styrene acrylic resin particles, and if necessary, other additives such as a colorant and a coating layer containing a binder resin and a release agent.

The volume average particle size (D50v) of the toner particles is preferably from 2 μm to 10 μm, and more preferably from 4 μm to 8 μm.

Various average particle sizes and various particle size distribution indices of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle size of 2 μm to 60 μm is measured by a Coulter Multisizer II using an aperture having an aperture size of 100 μm. 50,000 particles are sampled.

Cumulative distributions by volume and by number are drawn from the side of the smallest size with respect to particle size ranges (channels) separated based on the measured particle size distribution. The particle size when the cumulative percentage becomes 16% is defined as that corresponding to a volume average particle size D16v and a number-average particle size D16p, while the particle size when the cumulative percentage becomes 50% is defined as that corresponding to a volume average particle size D50v and a number-average particle size D50p. Furthermore, the particle size when the cumulative percentage becomes 84% is defined as that corresponding to a volume average particle size D84v and a number-average particle size D84p.

Using these, a volume average particle size distribution index (GSDv) is calculated as $(D84v/D16v)^{1/2}$, while a number-average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \qquad \text{Expression:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the foregoing expression, and an average value thereof is obtained.

External Additive

Examples of the external additive include inorganic particles. Examples of the inorganic particles include $SiO_2$, $TiO_2$, $Al_2O_3$ CuO, ZnO, $SnO_2$ $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, PMMA, and melamine resin particles) and a cleaning aid (e.g., metal salt of higher fatty acid represented by zinc stearate, and fluorine-based polymer particles).

The amount of the external additive externally added is, for example, preferably from 0.01% by weight to 5% by weight, and more preferably from 0.01% by weight to 2. 0% by weight with respect to the toner particles.

Toner Preparing Method

Next, a method of preparing a toner according to this exemplary embodiment will be described.

The toner according to this exemplary embodiment is obtained by externally adding an external additive to toner particles after preparing of the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

Specifically, for example, when the toner particles are prepared by an aggregation and coalescence method, the toner particles are prepared through the processes of: preparing a polyester resin particle dispersion in which polyester resin particles as a binder resin are dispersed (polyester resin particle dispersion preparation process); preparing a styrene (meth)acrylic resin particle dispersion in which styrene (meth)acrylic resin particles are dispersed (styrene(meth) acrylic resin particle dispersion preparation process); after mixing each resin particle dispersion (after mixing other particle dispersions, if necessary), aggregating each of the resin particles (if necessary, other particles) in the mixed dispersion to form first aggregated particles (first aggregated particle forming process); obtaining a first aggregated particle dispersion in which the first aggregated particles are dispersed, mixing the first aggregated particle dispersion and a dispersion in which the polyester resin particles and release agent particles are dispersed, aggregating the polyester resin particles and the release agent particles to be attached on the surface of the first aggregated particles to form second aggregated particles (second aggregated particle forming process); and heating the second aggregated particle dispersion in which the second aggregated particles are dispersed, to coalesce the second aggregated particles, thereby forming toner particles (coalescence process).

The preparing method of toner particles using an aggregation and coalescence method is suitable for obtaining the toner according to the exemplary embodiment.

Hereinafter, the respective processes will be described in detail.

In the following description, a method of obtaining toner particles containing a colorant will be described, but the colorant is used if necessary. Additives other than the colorant may be used.

In addition, a method of obtaining toner particles using an aggregating agent as the source of the aluminum element will be described, but there is no limitation thereto.

Particle Dispersion Preparation Process First, for example, a styrene(meth)acrylic resin particle dispersion in which styrene(meth)acrylic resin particles are dispersed and a colorant particle dispersion in which colorant particles are dispersed are prepared together with a polyester resin particle dispersion in which polyester resin particles as a binder resin are dispersed.

Herein, the polyester resin particle dispersion is prepared by, for example, dispersing polyester resin particles by a surfactant in a dispersion medium.

Examples of the dispersion medium used for the polyester resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap; cationic surfactants such as amine salt and quaternary ammonium salt; and nonionic surfactants such as polyethylene glycol, alkyl phenol ethylene oxide adduct, and polyol. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the polyester resin particle dispersion, as a method of dispersing the polyester resin particles in the dispersion medium, a common dispersing method using, for example, a rotary shearing-type homogenizer, or a ball mill, a sand mill, or a Dyno mill having media is exemplified. Depending on the kind of the polyester resin particles, polyester resin particles may be dispersed in the polyester resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

The volume average particle size of the polyester resin particles dispersed in the polyester resin particle dispersion is, for example, preferably from 0.01 μm to 1 μm, more preferably from 0.08 μm to 0.8 μm, and even more preferably from 0.1 μm to 0.6 μm.

Regarding the volume average particle size of the polyester resin particles, a cumulative distribution by volume is drawn from the side of the smallest size with respect to particle size ranges (channels) separated using the particle size distribution obtained by the measurement of a laser diffraction-type particle size distribution measuring device (for example, manufactured by Horiba, Ltd., LA-700), and a particle size when the cumulative percentage becomes 50% with respect to the entire particles is measured as a volume average particle size D50v. The volume average particle size of the particles in other dispersions is also measured in the same manner.

The content of the polyester resin particles contained in the polyester resin particle dispersion is, for example, preferably from 5% by weight to 50% by weight, and more preferably from 10% by weight to 40% by weight.

For example, the styrene(meth)acrylic resin particle dispersion and the colorant particle dispersion are also prepared in the same manner as in the case of the polyester resin particle dispersion. That is, the particles in the resin particle dispersion are the same as the styrene(meth)acrylic resin particles dispersed in the styrene(meth)acrylic resin particle dispersion and the colorant particles dispersed in the colorant particle dispersion, in terms of the volume average particle size, the dispersion medium, the dispersing method, and the content of the particles.

First Aggregated Particle Forming Process

Next, the styrene(meth)acrylic resin particle dispersion and the colorant particle dispersion are mixed together with the polyester resin particle dispersion.

The polyester resin particles, the styrene(meth)acrylic resin particles, and the colorant particles are heterogeneously aggregated in the mixed dispersion, thereby forming first aggregated particles having a size near a target toner particle size and including the polyester resin particles, the styrene (meth)acrylic resin particles, and the colorant particles.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated to a temperature of the glass transition temperature of the polyester resin particles (specifically, for example, from a temperature 30° C. lower than the glass transition temperature of the polyester resin particles to a temperature 10° C. lower than the glass transition temperature) to aggregate the particles dispersed in the mixed dispersion, thereby forming the first aggregated particles.

In the first aggregated particle forming process, for example, the aggregating agent may be added at room temperature (for example, 25° C.) under stirring of the mixed dispersion using a rotary shearing-type homogenizer, the pH of the mixed dispersion may be adjusted to be acidic (for example, the pH is from 2 to 5), a dispersion stabilizer may be added if necessary, and the heating may then be performed.

Examples of the aggregating agent include a surfactant having an opposite polarity to the polarity of the surfactant used as the dispersing agent to be added to the mixed dispersion, such as inorganic metal salts and di- or higher-valent metal complexes. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

The aggregating agent may be used as the source of the aluminum element (Al), and examples thereof include metal salts such as calcium chloride, calcium nitrate, aluminum chloride, and aluminum sulfate, and inorganic metal salt polymers such as polyaluminum chloride, and polyaluminum hydroxide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably from 0.01 part by weight to 5.0 parts by weight, and more preferably from 0.1 part by weight to less than 3.0 parts by weight with respect to 100 parts by weight of the resin particles.

Second Aggregated Particle Forming Process

Next, the obtained first aggregated particle dispersion in which the first aggregated particles are dispersed is mixed together with a dispersion in which the polyester resin particles and the release agent particles are dispersed. There is no limitation thereto, and for example, the first aggregated particle dispersion, the polyester resin particle dispersion in which polyester resin particles are dispersed, and the dispersion in which the release agent particles are dispersed, may be mixed with each other.

Herein, the dispersion in which the polyester resin particles and the release agent particles are dispersed is obtained, for example, by preparing each of the polyester resin particle dispersion in which polyester resin particles are dispersed and the dispersion in which the release agent particles are dispersed and mixing the respective dispersions. A release agent particle dispersion is prepared in the same manner as the polyester resin particle dispersion.

The polyester resin particles and the release agent particles are aggregated to be attached to the surface of the first aggregated particles in the mixed dispersion in which the first aggregated particles, the polyester resin particles, and the release agent particles are dispersed, thereby forming second aggregated particles in which the polyester resin particles and the release agent particles are attached to the surface of the first aggregated particles.

Specifically, in the first aggregated particle forming process, for example, when a particle size of the first aggregated particles reaches a target particle size, the dispersion in which the polyester resin particles and the release agent particles are dispersed is mixed with the first aggregated particle dispersion, and the mixed dispersion is heated at a temperature equal to or lower than the glass transition temperature of the polyester resin.

pH of the mixed dispersion is set to be in a range of 6.5 to 8.5, for example, and therefore the progress of the aggregation is stopped.

Accordingly, the second aggregated particles in which the polyester resin particles and the release agent particles are aggregated to be attached to the surface of the first aggregated particles are obtained.

Coalescence Process

Next, the second aggregated particle dispersion in which the second aggregated particles are dispersed is heated to, for example, a temperature that is equal to or higher than the glass transition temperature of the amorphous unsaturated polyester resin (for example, a temperature that is higher than the glass transition temperature of the polyester resin by 10° C. to 30° C.) to coalesce the second aggregated particles and form toner particles.

Toner particles are obtained through the foregoing processes.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to this exemplary embodiment is prepared by, for example, adding and mixing an external additive with dry toner particles that have been obtained. The mixing is preferably performed with, for example, a V-blender, a Henschel mixer, a Lodige mixer, or the like. Furthermore, if necessary, coarse toner particles may be removed using a vibration sieving machine, a wind classifier, or the like.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as conductive particles.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved or dispersed in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on a charged surface of the image holding member, a developing process of developing the electrostatic charge image formed on the surface of the image holding member with the electrostatic charge image developer according to this exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case of an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be shown. However, this image forming apparatus is not limited thereto. Major parts shown in the drawing will be described, but descriptions of other parts will be omitted.

FIG. 1 is a schematic diagram showing a configuration of the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative electrostatic charge image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased electrostatic charge image part on the surface of the photoreceptor 1Y, whereby the electrostatic charge image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 2:
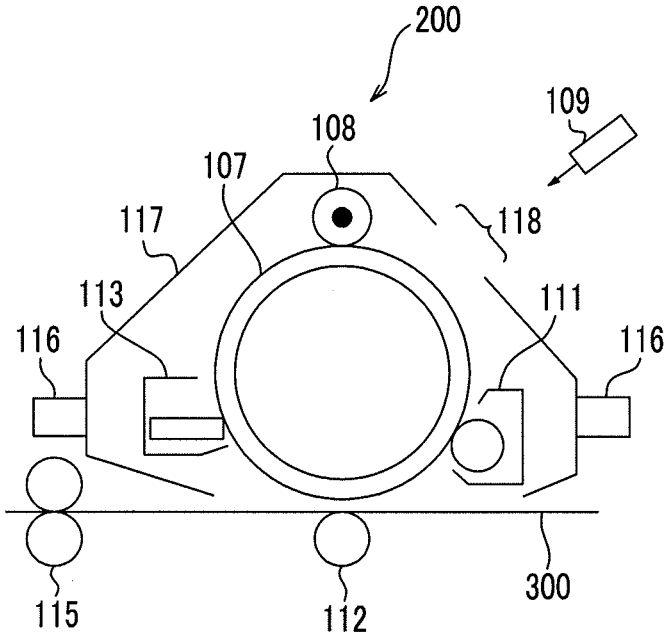
FIG. 2 is a diagram showing a position for measuring a gloss level in Examples.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment accommodates the toner according to this exemplary embodiment and is detachable from an image forming apparatus. The toner cartridge accommodates a toner for replenishment for being supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner accommodated in the toner cartridge runs low, the toner cartridge is replaced.

EXAMPLES

Hereinafter, this exemplary embodiment will be described in detail using examples and comparative examples, but is not limited to these examples. In the following description, unless specifically noted, "parts" and "%" are based on the weight.

Preparation of Polyester Resin Particle Dispersion

Preparation of Polyester Resin Particle Dispersion (1)

2.2 mol ethylene oxide adduct of bisphenol A: 40 parts by mol 2.2 mol propylene oxide adduct of bisphenol A: 60 parts by mol terephthalic acid: 47 parts by mol fumaric acid: 40 parts by mol dodecenyl succinic acid anhydride: 15 parts by mol trimellitic anhydride: 3 parts by mol The components of the monomer components described above except for fumaric acid and trimellitic anhydride, and 0.25 part of dioctanoic acid tin with respect to 100 parts of total monomer components described above are put in a reaction vessel including a stirrer, a thermometer, a capacitor, and a nitrogen gas introducing tube. Under the nitrogen gas flow, the mixture is subjected to a reaction at 235° C. for 6 hours and the temperature is dropped to 200° C., and fumaric acid and trimellitic anhydride are added thereto and subjected to a reaction for 1 hour. The mixture is further heated to 220° C. over 4 hours, and is polymerized under the pressure of 10 kPa until a desirable molecular weight is obtained, and a light yellow transparent polyester resin (1) is obtained.

Regarding the obtained polyester resin (1), the glass transition temperature Tg measured by DSC is 59° C., the weight-average molecular weight Mw measured by GPC is 25,000, the number-average molecular weight Mn is 7,000, a softening temperature measured by a flow tester is 107° C., and the acid value AV is 13 mgKOH/g.

Next, while maintaining a 3-liter jacketed reaction vessel (BJ-30N manufactured by Tokyo Rikakikai Co., Ltd.) including a capacitor, a thermometer, a water dropping device, and an anchor blade in a water circulating constant temperature vessel at 40° C., a mixed solvent of 160 parts of ethyl acetate and 100 parts of isopropyl alcohol is put in the reaction vessel, 300 parts of the polyester resin (1) is put therein, the mixture is stirred by using a three-one motor at 150 rpm and is dissolved to obtain an oil phase. 14 parts of 10% aqueous ammonia solution is added dropwise to the oil phase being stirred for 5 minutes and mixed therewith for 10 minutes, and 900 parts of ion exchange water is further added dropwise to the mixture at a rate of 7 parts per minute to perform phase inversion, and an emulsified solution is obtained.

Immediately after that, 800 parts of the obtained emulsified solution and 700 parts of ion exchange water are put in a 2-liter eggplant flask, and set in an evaporator (manufactured by Tokyo Rikakikai Co., Ltd.) including a vacuum control unit through a trap bump. The mixture is heated in a hot water bath at 60° C. while rotating the eggplant flask, the pressure is reduced to 7 kPa while paying attention to bumping, and the solvent is removed. The pressure is returned to the normal pressure when the solvent collection amount becomes 1,100 parts, the eggplant flask is cooled with water, and a dispersion is obtained. The obtained dispersion does not have an odor of the solvent. A volume average particle size D50 of the resin particles in this dispersion is 130 nm. After that, the ion exchange water is added thereto to have a solid content concentration of 20%, and this is set as a polyester resin particle dispersion (1).

Preparation of Polyester Resin Particle Dispersion (2)

1,10-dodecanedioic acid: 50 parts by mol 1,9-nonanediol: 50 parts by mol

The monomer components are put in a reaction vessel including a stirrer, a thermometer, a capacitor, and a nitrogen gas introducing tube, the atmosphere in the reaction vessel is substituted with dry nitrogen gas, and 0.25 part of titanium tetrabutoxide (reagent) with respect to 100 parts of the monomer components is added thereto. Under the nitrogen gas flow, the mixture is stirred and subjected to a reaction at 170° C. for 3 hours, and is further heated to 210° C. over 1 hour, the pressure in the reaction vessel is reduced to 3 kPa, the mixture is stirred and subjected to a reaction under the reduced pressure for 13 hours, and a polyester resin (2) is obtained.

Regarding the obtained polyester resin (2), the melting temperature measured by DSC is 73.6° C., the weight-average molecular weight Mw measured by GPC is 25,000, the number-average molecular weight Mn is 10,500, and the acid value AV is 10.1 mgKOH/g.

Next, 300 parts of the polyester resin (2), 160 parts of methylethyl ketone (solvent), and 100 parts of isopropyl alcohol (solvent) are put in a 3-liter jacketed reaction vessel (BJ-30N manufactured by Tokyo Rikakikai Co., Ltd.) including a capacitor, a thermometer, a water dropping device, and an anchor blade, and the mixture is stirred and mixed at 100 rpm while maintaining the reaction vessel in a water circulating constant temperature vessel at 70° C. to dissolve the resin (solution preparation process).

After that, the rotation rate when stirring is set to 150 rpm, the temperature of the water circulating constant temperature vessel is set at 66° C., 17 parts of the 10% aqueous ammonia (reagent) is added dropwise thereto over 10 minutes, the total 900 parts of ion exchange water kept warm at 66° C. is added dropwise thereto at a rate of 7 part/min to perform phase inversion, and an emulsified solution is obtained.

Immediately after that, 800 parts of the obtained emulsified solution and 700 parts of ion exchange water are put in a 2-liter eggplant flask, and set in an evaporator (manufactured by Tokyo Rikakikai Co., Ltd.) including a vacuum control unit through a trap bump. The mixture is heated in a hot water bath at 60° C. while rotating the eggplant flask, the pressure is reduced to 7 kPa while paying attention to bumping, and the solvent is removed. The pressure is returned to the normal pressure when the solvent collection amount becomes 1,100 parts, the eggplant flask is cooled with water, and a dispersion is obtained. The obtained dispersion does not have an odor of the solvent. A volume average particle size D50v of the resin particles in this dispersion is 130 nm. After that, the ion exchange water is added thereto to have a solid content concentration of 20%, and this is set as a polyester resin particle dispersion (2).

Preparation of Styrene (Meth)Acrylic Resin Particle Dispersion

Preparation of Styrene-Acrylic Resin Particles (1)

Styrene (manufactured by Wako Pure Chemical Industries, Ltd.): 300 parts n-butyl acrylate (manufactured by Wako Pure Chemical Industries, Ltd.): 84 parts 1,10-decanediol diacrylate (Shin-Nakamura Chemical Co., Ltd.): 1.4 parts Dodecanethiol (manufactured by Wako Pure Chemical Industries, Ltd.): 3.0 parts A solution obtained by dissolving 4.0 parts of anionic surfactant Dowfax (manufactured by The Dow Chemical Company) in 800 parts of ion exchange water is added to a resultant material obtained by mixing and dissolving the above components, and the mixture is dispersed and emulsified in a flask, and gently mixed for 10 minutes, and 50 parts of ion exchange water in which 4.0 parts of ammonium persulfate is dissolved is put thereto. Next, after performing nitrogen substitution in the flask, the solution is heated in an oil bath to be 65° C. while stirring the solution in the flask, emulsification and polymerization is continued for 5 hours as it is, and a styrene acrylic resin particle dispersion (1) is obtained. The volume average particle size of particles in the styrene acrylic resin particle dispersion (1) is 120 nm, the solid content thereof is 32%, and the weight-average molecular weight Mw thereof is 50,000.

Preparation of Styrene-Acrylic Resin Particles (2) Styrene acrylic resin particles (2) are obtained in the same manner as the styrene acrylic resin particles (1), except for changing the added amount of dodecanethiol to 8.5 parts. The volume average particle size of particles in the styrene acrylic resin particle dispersion (2) is 120 nm, the solid content thereof is 32%, and the weight-average molecular weight Mw thereof is 30,000.

Preparation of Styrene-Acrylic Resin Particles (3)

Styrene acrylic resin particles (3) are obtained in the same manner as the styrene acrylic resin particles (1), except that dodecanethiol is not used. The volume average particle size of particles in the styrene acrylic resin particle dispersion (3) is 120 nm, the solid content thereof is 32%, and the weight-average molecular weight Mw thereof is 200,000.

Preparation of Styrene-Acrylic Resin Particles (4)

Styrene acrylic resin particles (4) are obtained in the same manner as the styrene acrylic resin particles (1), except that 1,10-decanediol diacrylate is not used. The volume average particle size of particles in the styrene acrylic resin particle dispersion (4) is 120 nm, the solid content thereof is 32%, and the weight-average molecular weight Mw thereof is 50,000.

Preparation of Styrene-Acrylic Resin Particles (5)

Styrene acrylic resin particles (5) are obtained in the same manner as the styrene acrylic resin particles (1), except for changing the added amount of dodecanethiol to 12.5 parts. The volume average particle size of particles in the styrene acrylic resin particle dispersion (5) is 120 nm, the solid content thereof is 32%, and the weight-average molecular weight Mw thereof is 20,000.

Preparation of Styrene-Acrylic Resin Particles (6)

Styrene acrylic resin particles (6) are obtained in the same manner as the styrene acrylic resin particles (1), except that the added amount of ammonium persulfate is changed to 1.0 part and dodecanethiol is not used. The volume average particle size of particles in the styrene acrylic resin particle dispersion (6) is 120 nm, the solid content thereof is 32%, and the weight-average molecular weight Mw thereof is 240,000.

Preparation of Colorant Particle Dispersion

Preparation of Black Pigment Dispersion (1)

Carbon black (Regal 330 manufactured by Cabot Corporation): 250 parts

Anionic surfactant (NEOGEN SC manufactured by Dai-Ichi Kogyo Seiyaku Co., Ltd.): 33 parts (60% of active ingredient, 8% with respect to the colorant)

Ion exchange water: 750 parts 280 parts of ion exchange water and 33 parts of anionic surfactant are put in a stainless steel vessel having a size that a height of a liquid surface when all of the above components are put therein is approximately ⅓ of the height of the vessel, the surfactant is sufficiently dissolved, the solid solution pigments are all put therein, the resultant material is stirred using a stirrer until the pigments not wet yet disappears, and sufficiently defoamed. The remaining ion exchange water is added thereto after the defoaming, the obtained mixture is dispersed by using a homogenizer (Ultra Turrax T50 manufactured by IKA Japan, K.K.) with 5000 rotations for 10 minutes, is stirred using the stirrer for 24 hours and defoamed. After the defoaming, the resultant material is dispersed again by using the homogenizer with 6000 rotations for 10 minutes, is stirred using the stirrer for 24 hours and defoamed. Then, the dispersion is dispersed by using a high pressure impact type dispersing machine ULTIMIZER (HJP30006 manufactured by Sugino Machine, Ltd.) at pressure of 240 MPa. The dispersion is performed to be equivalent to 25 passes with the conversion from the total introduction amount and processing capacity of the device. The obtained dispersion is left for 72 hours to remove precipitates, ion exchange water is added thereto to adjust a solid content concentration to 15%, and a colorant particle dispersion (1) is obtained. The volume average particle size D50 of particles in the colorant particle dispersion (1) is 135 nm.

Preparation of Release Agent Particle Dispersion

Preparation of Release Agent Particle Dispersion (1)

Polyethylene wax (hydrocarbon-based wax: product name "POLYWAX 725 (manufactured by Baker Petrolite Co., Ltd.)", melting temperature of 104° C.): 270 parts Anionic surfactant (NEOGEN RK manufactured by Dai-Ichi Kogyo Seiyaku Co., Ltd., active ingredient amount: 60%): 13.5 parts (3.0% of active ingredient with respect to the release agent)

Ion exchange water: 21.6 parts

After mixing the above components and dissolving the release agent by using a pressure discharge type homogenizer (Gaulin homogenizer manufactured by Gaulin) at an internal liquid temperature of 120° C., dispersion process is performed at a dispersion pressure of 5 Mpa for 120 minutes and then at a dispersion pressure of 40 MPa for 360 minutes, the mixture is cooled, and a release agent particle dispersion (1) is obtained. The volume average particle size D50 of particles in the release agent particle dispersion (1) is 225 nm. After that, ion exchange water is added thereto to adjust a solid content concentration to 20.0%.

Preparation of Release Agent Particle Dispersion (2)

A release agent particle dispersion (2) is obtained in the same manner as the release agent particle dispersion (1), except for changing polyethylene wax to paraffin wax (hydrocarbon-based wax: product name "HNP 0190 (manufactured by Nippon Seiro Co., Ltd.)", melting temperature of 85° C.).

Preparation of Release Agent Particle Dispersion (3)

A release agent particle dispersion (3) is obtained in the same manner as the release agent particle dispersion (1), except for changing polyethylene wax to paraffin wax (hydrocarbon-based wax: product name "HNP 9 (manufactured by Nippon Seiro Co., Ltd.)", melting temperature of 75° C.).

Preparation of Release Agent Particle Dispersion (4)

A release agent particle dispersion (4) is obtained in the same manner as the release agent particle dispersion (1), except for changing polyethylene wax to polyethylene wax (hydrocarbon-based wax: product name "POLYWAX 1000 (manufactured by Baker Petrolite Co., Ltd.)", melting temperature of 113° C.)

Preparation of Release Agent Particle Dispersion (5)

A release agent particle dispersion (5) is obtained in the same manner as the release agent particle dispersion (1), except for changing polyethylene wax to terminal carboxylic acid synthesis ester wax (ester wax: product name "KUROBAX 300-6S (manufactured by Nippon Kasei Chemical Co., Ltd.)", melting temperature of 95° C.)

Preparation of Mixed Particle Dispersion

Preparation of Mixed Particle Dispersion (1)

100 parts of the polyester resin particle dispersion (1) and 12 parts of the release agent particle dispersion (1) are mixed with each other, and a mixed particle dispersion (1) is obtained.

Preparation of Mixed Particle Dispersions (2) to (5)

Mixed particle dispersions (2) to (5) are obtained in the same manner as the mixed particle dispersion (1), except for changing the release agent particle dispersion (1) to the release agent particle dispersions (2) to (5), respectively.

Preparation of Mixed Particle Dispersion (6)

100 parts of the polyester resin particle dispersion (1) and 18 parts of the release agent particle dispersion (1) are mixed with each other, and a mixed particle dispersion (6) is obtained.

Preparation of Aluminum Sulfate Aqueous Solution

Aluminum sulfate powder (manufactured by Asada Chemical INDUSTRY Co., Ltd.: 17% aluminum sulfate): 35 parts Ion exchange water: 1,965 parts The above components are put in a 2-liter vessel, stirred and mixed at 30° C. until the precipitate is eliminated, and an aluminum sulfate aqueous solution is prepared.

Example 1

Preparation of Toner Particles

Polyester resin particle dispersion (1): 700 parts

Polyester resin particle dispersion (2): 50 parts

Styrene(meth)acrylic resin particle dispersion (1): 204 parts

Colorant particle dispersion (1): 133 parts

Ion exchange water: 350 parts

Anionic surfactant (Dowfax2A1 manufactured by The Dow Chemical Company): 2.9 parts After putting the above components in a 3-liter reaction vessel including a thermometer, a pH meter, and a stirrer, and adding 1.0% nitric acid at 25° C. to adjust pH to 3.0, 130 parts of the prepared aluminum sulfate aqueous solution is added thereto while performing dispersion using a homogenizer (Ultra Turrax T50 manufactured by IKA Japan, K.K.) at 5,000 rpm and dispersion is performed for 6 minutes.

After that, a stirrer and a mantle heater are installed in the reaction vessel, the temperature is raised at a rate of temperature rise of 0.2° C./min up to 40° C. and at a rate of temperature rise of 0.05° C./min when the temperature is higher than 40° C. while adjusting the rotation rate of the stirrer so that the slurry is sufficiently stirred, and a particle size is measured using Multisizer II (manufactured by Coulter, Inc., aperture size: 50 μm) for every 10 minutes. The temperature is kept when a volume average particle size is 5.0 μm, and 430 parts of the mixed particle dispersion (1) is put therein over 5 minutes.

After holding the resultant material for 30 minutes, pH is adjusted to 9.0 using 1% aqueous sodium hydroxide solution. After that, the resultant material is heated to 90° C. at the rate of temperature rise of 1° C./rain while adjusting pH to 9.0 in the same manner as described above for every time when the temperature rises 5° C., and the temperature is held at 98° C. When a particle shape and a surface property are observed with an optical microscope and a scanning electron microscope (FE-SEM), coalescence of the particles are confirmed when 10.0 hours has elapsed, and accordingly the vessel is cooled with cooling water to 30° C. over 5 minutes.

The cooled slurry passes through nylon mesh of a mesh size of 15 μm to remove coarse powder, and toner slurry which has passed through the mesh is filtrated using an aspirator under the reduced pressure. The toner remaining on filter paper is crushed into pieces as small as possible, and put into the ion exchange water having an amount of 10 times the amount of the toner at 30° C. and stirred and mixed for 30minutes. Next, the mixture is filtrated using an aspirator under the reduced pressure, the toner remaining on the filter paper is crushed into pieces as small as possible, and put into the ion exchange water having an amount of 10 times the amount of the toner at 30° C. and stirred and mixed for 30 minutes. After that the mixture is filtrated again using an aspirator under the reduced pressure, and electrical conductivity of the filtrate is measured. This operation is repeated until the electrical conductivity of the filtrate becomes equal to or less than 10 μS/cm, and the toner is washed.

The washed toner is crushed into small pieces with a wet type and dry-type granulator (Comil), is subjected to vacuum drying in an oven at 35° C. for 36 hours, and toner particles (1) are obtained.

The volume average particle size D50 of the obtained toner particles (1) is 6.0 μm.

Preparation of Toner (1)

0.5 part of hydrophobic silica (RX50 manufactured by Aerosil Nippon Co., Ltd.) and 1.5 parts of hydrophobic silica (R972 manufactured by Aerosil Nippon Co., Ltd.) are mixed with 100 parts of the obtained toner particles (1) with a Henschel mixer at a peripheral speed of 20 m/s for 15 minutes, coarse particles are removed using a sieving machine having a mesh of 45 μm, and toner (1) is obtained.

Preparation of Carrier (1)

14 parts of toluene, 2 parts of a styrene-methyl methacrylate copolymer (weight ratio: 80/20, weight-average molecular weight: 70,000), and 0.6 part of MZ500 (zinc oxide, Titan Kogyo, Ltd.) are mixed with each other and stirred with a stirrer for 10 minutes, and a coating layer forming solution in which zinc oxide is dispersed is prepared. Next, the coating solution and 100 parts of ferrite particles (volume average particle size: 38 μm) are put into a vacuum deaeration kneader and stirred at 60° C. for 30 minutes, then the pressure is reduced for deaeration while heating, and drying is performed to prepare a carrier.

Preparation of Developer (1)

8 parts of the toner (1) and 100 parts of the carrier are mixed with each other in a V-blender, and a developer (1) is prepared.

Example 2

A developer (2) is prepared in the same manner as the developer (1) of Example 1, except for changing the added amount of the polyester resin particle dispersion (1) to 815 parts, the added amount of the polyester resin particle dispersion (2) to 58 parts, and the added amount of the mixed particle dispersion (1) to 507 parts.

Example 3

A developer (3) is prepared in the same manner as the developer (1) of Example 1, except for changing the added amount of the aluminum sulfate aqueous solution to 100 parts.

Example 4

A developer (4) is prepared in the same manner as the developer (1) of Example 1, except for changing the added amount of the aluminum sulfate aqueous solution to 160 parts.

Example 5

A developer (5) is prepared in the same manner as the developer (1) of Example 1, except for changing the release agent particle dispersion (1) to the release agent particle dispersion (2).

Example 6

A developer (6) is prepared in the same manner as the developer (1) of Example 1, except for changing the mixed particle dispersion (1) to the mixed particle dispersion (3).

Example 7

A developer (7) is prepared in the same manner as the developer (1) of Example 1, except for changing the mixed particle dispersion (1) to the mixed particle dispersion (4).

Example 8

A developer (8) is prepared in the same manner as the developer (1) of Example 1, except for changing the added amount of the polyester resin particle dispersion (1) to 815 parts, the added amount of the polyester resin particle dispersion (2) to 58 parts, the mixed particle dispersion (1) to the mixed particle dispersion (6), and the added amount of the mixed particle dispersion (6) to 307 parts.

Example 9

A developer (9) is prepared in the same manner as the developer (1) of Example 1, except for changing the styrene (meth)acrylic resin particle dispersion (1) to the styrene (meth)acrylic resin particle dispersion (2).

Example 10

A developer (10) is prepared in the same manner as the developer (1) of Example 1, except for changing the styrene (meth)acrylic resin particle dispersion (1) to the styrene (meth)acrylic resin particle dispersion (3).

Example 11

A developer (11) is prepared in the same manner as the developer (1) of Example 1, except for changing the styrene (meth)acrylic resin particle dispersion (1) to the styrene (meth)acrylic resin particle dispersion (4).

Example 12

A developer (12) is prepared in the same manner as the developer (1) of Example 1, except for changing the styrene (meth)acrylic resin particle dispersion (1) to the styrene (meth)acrylic resin particle dispersion (5).

Example 13

A developer (13) is prepared in the same manner as the developer (1) of Example 1, except for changing the styrene (meth)acrylic resin particle dispersion (1) to the styrene (meth)acrylic resin particle dispersion (6).

Example 14

A developer (14) is prepared in the same manner as the developer (1) of Example 1, except for changing the added amount of the polyester resin particle dispersion (1) to 852 parts, the added amount of the polyester resin particle dispersion (2) to 61 parts, and the added amount of the styrene (meth)acrylic resin particle dispersion (1) to 102 parts.

Example 15

A developer (15) is prepared in the same manner as the developer (1) of Example 1, except for changing the added amount of the polyester resin particle dispersion (1) to 550 parts, the added amount of the polyester resin particle dispersion (2) to 40 parts, and the added amount of the styrene (meth)acrylic resin particle dispersion (1) to 306 parts.

Example 16

A developer (16) is prepared in the same manner as the developer (1) of Example 1, except for changing the added amount of the polyester resin particle dispersion (1) to 927 parts, the added amount of the polyester resin particle dispersion (2) to 66 parts, and the added amount of the styrene (meth)acrylic resin particle dispersion (1) to 51 parts.

Example 17

A developer (17) is prepared in the same manner as the developer (1) of Example 1, except for changing the added amount of the polyester resin particle dispersion (1) to 474 parts, the added amount of the polyester resin particle dispersion (2) to 35 parts, and the added amount of the styrene (meth)acrylic resin particle dispersion (1) to 357 parts.

Comparative Example 1

A comparative developer (C1) is prepared in the same manner as the developer (1) of Example 1, except for changing the added amount of the polyester resin particle dispersion (1) to 585 parts, the added amount of the polyester resin particle dispersion (2) to 42 parts, and the added amount of the mixed particle dispersion (1) to 553 parts.

Comparative Example 2

A comparative developer (C4) is prepared in the same manner as the developer (1) of Example 1, except for changing the mixed particle dispersion (1) to the mixed particle dispersion (5).

Comparative Example 3

A comparative developer (C2) is prepared in the same manner as the developer (1) of Example 1, except for changing the added amount of the aluminum sulfate aqueous solution to 100 parts, and adding the mixed particle dispersion (1) and holding the resultant material for 30 minutes, and then adjusting pH to 9.5 using 1% aqueous sodium hydroxide solution.

Comparative Example 4

A comparative developer (C3) is prepared in the same manner as the developer (1) of Example 1, except for changing the added amount of the aluminum sulfate aqueous solution to 160 parts, and adding the mixed particle dispersion (1) and holding the resultant material for 30 minutes, and then adjusting pH to 8.5 using 1% aqueous sodium hydroxide solution.

Evaluation

An "existence ratio of the release agent", an "exposure rate of the release agent", a "number-average particle size of the styrene(meth)acrylic resin particles", and "fluorescent X-ray NET intensity of the aluminum element (Al)" of the toner particles of the developer obtained in each example are obtained with a well-known method. The results are shown in Table 1 and Table 2.

In addition, the developer obtained in each example is filled in a developing device of an image forming apparatus "DocuPrint P450d (manufactured by Fuji Xerox Co., Ltd.): processing speed of 260 mm/s, fixing pressure of the fixing device of 0.20 N/mm$^2$". The following evaluations are performed by using this image forming apparatus. The results of the evaluation are shown in Table 1 and Table 2.

Evaluation of Gloss Unevenness of Half-Tone Image

The evaluation of the gloss unevenness of a half-tone image is performed as follows.

A half-tone image with image density of 50% is output on the entire surface of a sheet (P paper: manufactured by Fuji Xerox Co., Ltd.) by the image forming apparatus. The output of the image is performed in the environment with a room temperature and normal humidity.

The gloss unevenness of the obtained half-tone image is evaluated with the following criteria.

A: Excellent image with no generation of the gloss unevenness on the half-tone image.

B: Extremely slight gloss unevenness is observed on the half-tone image, but it is a level with no practical problem.

C: The gloss unevenness is observed on the half-tone image, and it is not practically an allowable level.

D: The gloss unevenness is significantly generated on the half-tone image, and it is absolutely not practically an allowable level.

Evaluation of Hot Offset Resistance

An image with image density of 100% and edge margin part of 2 mm is output on the entire surface of the sheet (P paper: manufactured by Fuji Xerox Co., Ltd.) by the image forming apparatus. A setting temperature of a surface of a fixing roller of the fixing device is sequentially changed in a range of 100° C. to 220° C. in each output, the generation of the hot offset at each temperature (phenomenon of degradation of a peeling property in a high temperature part in fixation and fusion of image to a fixing member) is observed, and the evaluation is performed with the following evaluation criteria. A white part of the sheet is subjected to the measurement with a density measurement device X-lite 404, and if the measurement numerical value is equal to or smaller than 0.05, the generation of the offset is evaluated as to be allowable. The evaluation criteria are as follows.

A: The hot offset generation temperature is equal to or higher than 210° C.

B: The hot offset generation temperature is equal to or higher than 190° C. and less than 210° C.

C: The hot offset generation temperature is equal to or higher than 170° C. and less than 190° C.

D: The hot offset generation temperature is less than 170° C.

Evaluation of Low Glossiness

A solid image of 3 cm×3 cm (toner amount of 5.4 g/m2) is formed on the sheet (P paper: manufactured by Fuji Xerox Co., Ltd.) by the image forming apparatus. The glossiness of the obtained solid image is measured by a glossmeter GM-26D (manufactured by Murakami Color Research Laboratory) under the condition with an angle of incident light to the image of 75°.

The low glossiness is evaluated with the following criteria.

A: Less than 10

B: Equal to or more than 10 and less than 15

C: Equal to or more than 15 and less than 20

D: Equal to or more than 20

TABLE 1

| | Releasing agent | | | | Styrene (meth)acrylic resin particles | | | | Fluorescent X-ray NET | Gloss | | |
|---|---|---|---|---|---|---|---|---|---|---|---|---|
| No. | Type | Melting temperature [° C.] | Existence ratio of release agent [%] | Exposure rate of release agent [atm %] | Content [% with respect to toner particles] | Weight-average molecular weight (Mw) | Number-average molecular weight [nm] | Cross-linking structure | intensity of aluminum element (Al) | unevenness of half-tone image | Hot offset resistance | Low glossiness |
| Ex. 1 | Polyethylene wax | 104 | 80 | 3 | 20 | 50000 | 120 | Obtained | 0.2 | A | A | A |
| Ex. 2 | Polyethylene wax | 104 | 70 | 2 | 20 | 50000 | 120 | Obtained | 0.2 | B | A | A |
| Ex. 3 | Polyethylene wax | 104 | 80 | 3 | 20 | 50000 | 120 | Obtained | 0.15 | A | A | B |
| Ex. 4 | Polyethylene wax | 104 | 80 | 3 | 20 | 50000 | 120 | Obtained | 0.3 | B | A | A |
| Ex. 5 | Paraffin wax | 85 | 80 | 5.8 | 20 | 50000 | 120 | Obtained | 0.2 | A | A | B |
| Ex. 6 | Paraffin wax | 75 | 80 | 6.2 | 20 | 50000 | 120 | Obtained | 0.2 | A | B | B |
| Ex. 7 | Polyethylene wax | 113 | 80 | 2.6 | 20 | 50000 | 120 | Obtained | 0.2 | B | B | A |
| Ex. 8 | Polyethylene wax | 104 | 80 | 10 | 20 | 50000 | 120 | Obtained | 0.2 | B | A | A |
| Ex. 9 | Polyethylene wax | 104 | 80 | 3 | 20 | 30000 | 120 | Obtained | 0.2 | A | A | B |
| Ex. 10 | Polyethylene wax | 104 | 80 | 3 | 20 | 200000 | 120 | Obtained | 0.2 | B | A | A |
| Ex. 11 | Polyethylene wax | 104 | 80 | 3 | 20 | 50000 | 120 | None | 0.2 | A | B | B |
| Ex. 12 | Polyethylene wax | 104 | 80 | 3 | 20 | 20000 | 120 | Obtained | 0.2 | A | B | B |

TABLE 2

| | Releasing agent | | | | Styrene (meth)acrylic resin particles | | | | Fluorescent X-ray NET | Gloss | | |
|---|---|---|---|---|---|---|---|---|---|---|---|---|
| No. | Type | Melting temperature [° C.] | Existence ratio of release agent [%] | Exposure rate of release agent [atm %] | Content [% with respect to toner particles] | Weight-average molecular weight (Mw) | Number-average molecular weight [nm] | Cross-linking structure | intensity of aluminum element (Al) | unevenness of half-tone image | Hot offset resistance | Low glossiness |
| Ex. 13 | Polyethylene wax | 104 | 80 | 3 | 20 | 240000 | 120 | Obtained | 0.2 | B | B | A |
| Ex. 14 | Polyethylene wax | 104 | 80 | 3 | 10 | 50000 | 120 | Obtained | 0.2 | A | B | A |
| Ex. 15 | Polyethylene wax | 104 | 80 | 3 | 30 | 50000 | 120 | Obtained | 0.2 | B | A | A |
| Ex. 16 | Polyethylene wax | 104 | 80 | 3 | 5 | 50000 | 120 | Obtained | 0.2 | A | B | B |
| Ex. 17 | Polyethylene wax | 104 | 80 | 3 | 35 | 50000 | 120 | Obtained | 0.2 | B | B | A |
| Com. Ex. 1 | Polyethylene wax | 104 | 60 | 3 | 20 | 50000 | 120 | Obtained | 0.2 | D | B | A |
| Com. Ex. 2 | Ester wax | 95 | 80 | 3 | 20 | 50000 | 120 | Obtained | 0.2 | C | A | A |
| Com. Ex. 3 | Polyethylene wax | 104 | 20 | 3 | 20 | 50000 | 120 | Obtained | 0.08 | A | C | D |
| Com. Ex. 4 | Polyethylene wax | 104 | 20 | 3 | 20 | 50000 | 120 | Obtained | 0.35 | D | B | A |

From the above results, it is found that a good evaluation is obtained in the examples regarding the gloss unevenness of the half-tone image, the hot offset resistance, and the low glossiness, compared to the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising toner particles containing:

a binder resin containing a polyester resin;

a release agent containing hydrocarbon-based wax;

styrene(meth)acrylic resin particles; and an aluminum element, wherein fluorescent X-ray NET intensity of the aluminum element existing in the toner particles is from 0.1 to 0.3, and 70% or more of the release agent among the entire release agent exists within 800 nm from the surface of the toner particles.

2. The electrostatic charge image developing toner according to claim 1, wherein a melting temperature of the release agent is from 85° C. to 110° C.

3. The electrostatic charge image developing toner according to claim 1, wherein an exposure rate of the release agent on the surface of the toner particles is equal to or smaller than 8 atomic %.

4. The electrostatic charge image developing toner according to claim 1, wherein the styrene(meth)acrylic resin particles have a crosslinked structure, and a weight-average molecular weight Mw of the styrene(meth)acrylic resin particles is from 30,000 to 200,000.

5. The electrostatic charge image developing toner according to claim 1, wherein a content of the styrene (meth)acrylic resin particles is from 10% by weight to 30% by weight with respect to the toner particles.

6. The electrostatic charge image developing toner according to claim 1, wherein a number average particle size of the styrene(meth)acrylic resin particles is in a range of 70 nm to 300 nm.

7. The electrostatic charge image developing toner according to claim 1, wherein a weight ratio of the release agent and the styrene(meth)acrylic resin particles is in a range of 1:6 to 2:1.

8. An electrostatic charge image developer comprising the electrostatic charge image developing toner according to claim 1.

9. A process cartridge comprising:

a developing unit that accommodates the electrostatic charge image developer according to claim 8, and develops an electrostatic charge image formed on a surface of an image holding member as a toner image with the electrostatic charge image developer, wherein the process cartridge is detachable from an image forming apparatus.

10. A toner cartridge that contains the electrostatic charge image developing toner according to claim 1, and is detachable from an image forming apparatus.

* * * * *